United States Patent [19]

Ulicny

[11] Patent Number: 4,581,987

[45] Date of Patent: Apr. 15, 1986

[54] FIRE DAMPER ACTUATOR

[75] Inventor: Dennis J. Ulicny, Carpentersville, Ill.

[73] Assignee: ECM Motor Co., Schaumburg, Ill.

[21] Appl. No.: 739,205

[22] Filed: May 30, 1985

[51] Int. Cl.[4] ..... F24F 7/00

[52] U.S. Cl. ..... 98/1; 98/110; 98/121.2; 49/5

[58] Field of Search ..... 98/1, 110, 121.2; 49/5

[56] References Cited

U.S. PATENT DOCUMENTS 4,432,272 2/1984 Becealere ..... 98/1

OTHER PUBLICATIONS

Product brochure; *Honeywell Modutrol Motors;* M934A, D, E; pp. 1-6, revised Aug. 1975; M445 A, A; M845 A, C, E; pp. 1-8, copyright 1984.

Product brochure; *Honeywell Dedicated Economizer Actuators;* pp. 1-6; copyright 1985.

*Primary Examiner*—Larry I. Schwartz

*Attorney, Agent, or Firm*—Dressler, Goldsmith, Shore, Sutker & Milnamow, Ltd.

[57] ABSTRACT

An electrically-operated fire damper actuator is disclosed which is adapted to operate an associated fire damper having louvers movable between opened and closed positions, with the damper or the actuator including a closing spring which urges the louvers to the closed position. The present actuator is configured to open the louvers in opposition to the closing spring, and maintain the damper in an opened condition against the action of the closing spring, while permitting the damper to close in the event of loss of power to the actuator. The actuator comprises an electric motor which operates through a multi-stage gear reduction unit for opening the louvers in opposition to the closing spring, and further includes an electric brake operatively connected to the motor rotor shaft for maintaining the damper louvers in the opened position. The present actuator further includes a one-way clutch mechanism with the gear reduction unit for avoiding damage to the reducing gears as the damper louvers move to the fully closed position under the action of the closing spring.

12 Claims, 10 Drawing Figures

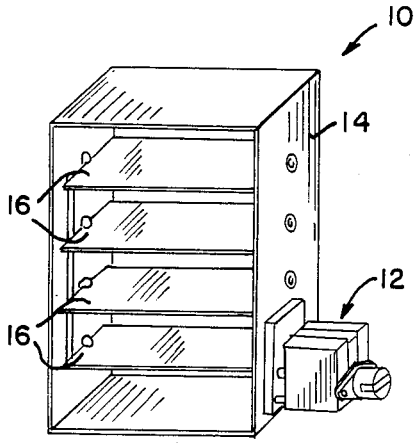
FIG. 1
FIG. 2
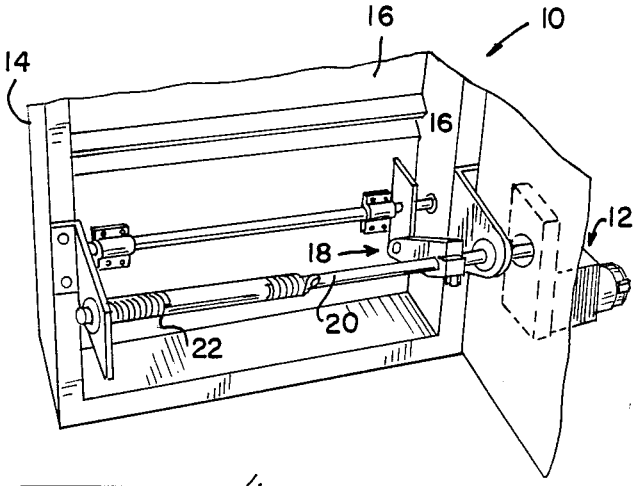
FIG. 4
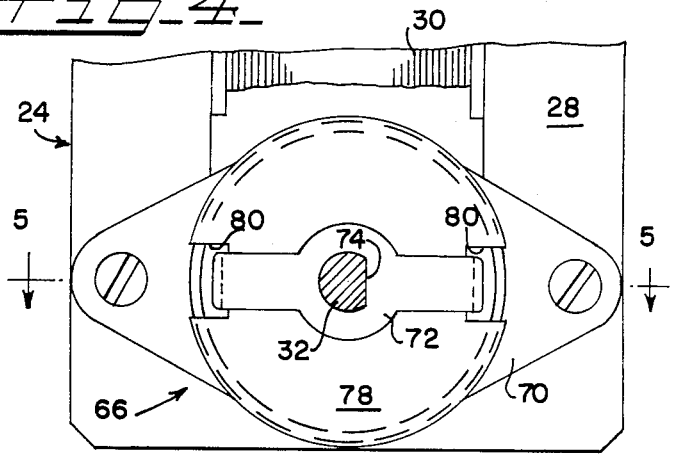
FIG. 3
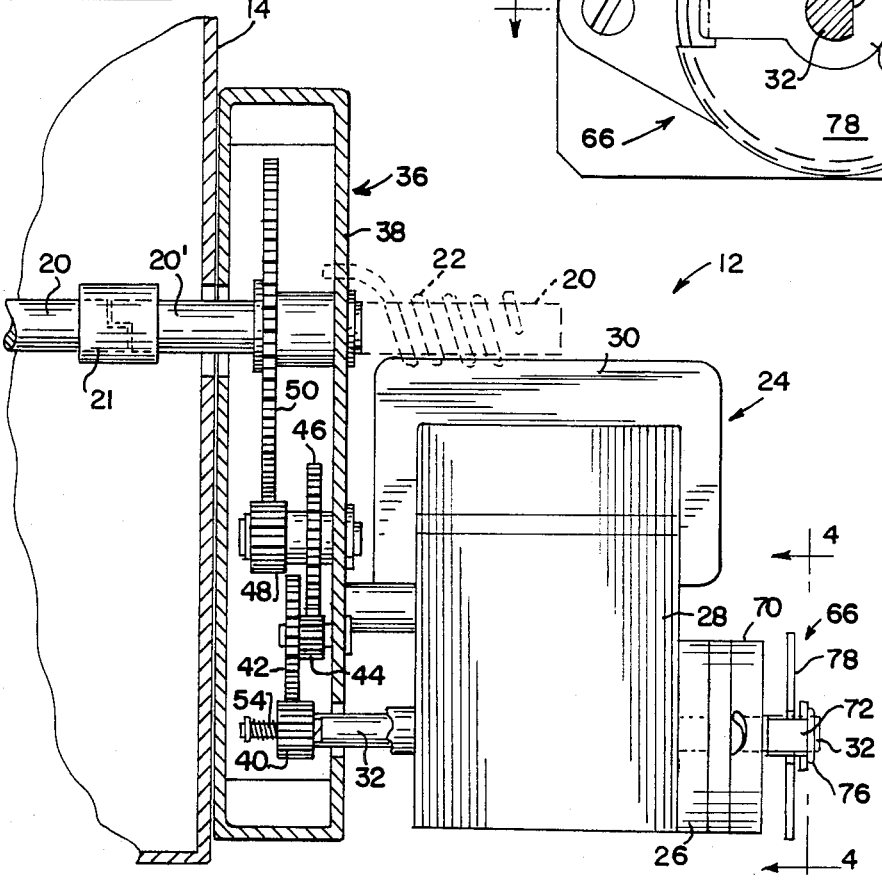

FIG. 5
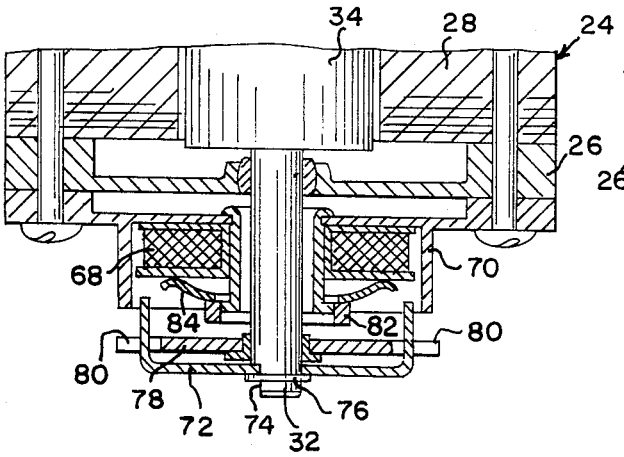
FIG. 6
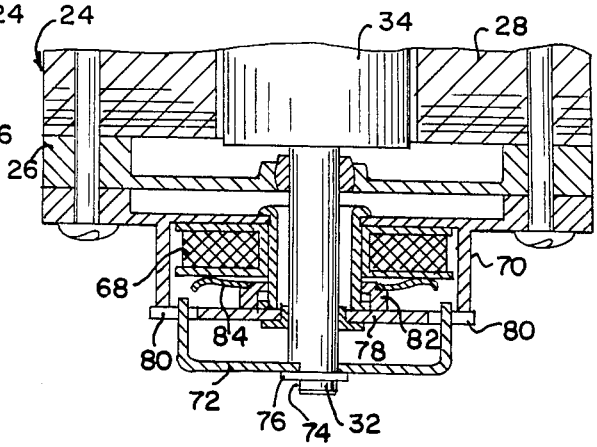
FIG. 7
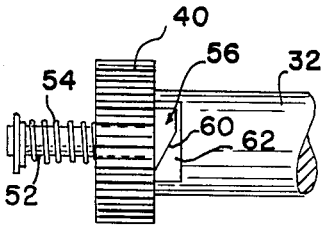
FIG. 9
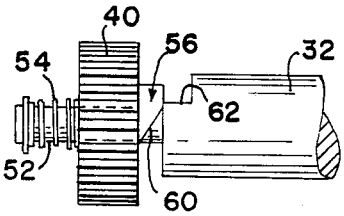
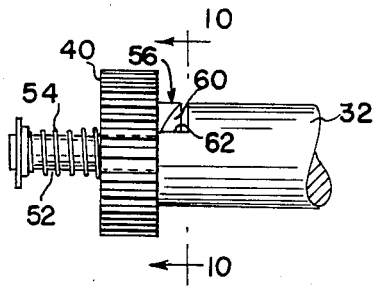
FIG. 8
FIG. 10
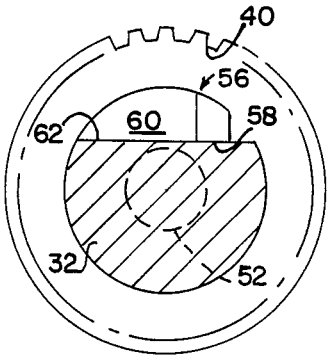

FIRE DAMPER ACTUATOR

TECHNICAL FIELD

The present invention relates generally to electrical operating devices for fire dampers in ventilation systems which function to permit closing of a damper in the event of power failure, and which function to open and close the damper to regulate airflow in normal operation; and more particularly to a fire damper actuator configured for economical manufacture, reliable operation, and low noise and power consumption in use.

BACKGROUND OF THE INVENTION

Ventilation systems in many buildings are provided with fire dampers at various points in the system. Such fire dampers typically include movable louvers which are either open, allowing free flow of air, or closed, thereby preventing airflow through the associated duct work. A fire damper of this nature is typically operated by an electric actuator. In addition to being able to open and close the damper, the actuator for a fire damper must be configured to permit the associated damper to close from an opened position in the event of loss of electrical power to the actuator. This is typically accomplished by having the actuator "wind up" and tension an associated closing spring while the actuator is opening the damper, with the spring being capable of closing the damper in the event of power loss. Thus, the actuator maintains the damper in an opened position with the associated closing spring "wound up", whereupon a loss of power causes the actuator to release the damper and spring, permitting the spring to close the louvers of the damper. The closing spring may be part of the damper assembly, or may be incorporated in the damper actuator.

As will be appreciated, a number of important considerations must be kept in mind in designing a fire damper actuator mechanism. Since the ventilation system of a building may require many such actuators, an actuator must be economical to manufacture and use if it is to be commercially viable. Thus of concern is the amount of electrical power consumed by the actuator while it continuously holds the damper open. Also of concern is the noise generated by the actuator as it holds the damper in its opened position. While a fire damper actuator may be required to hold the associated damper in an opened position for many months, the actuator must reliably permit the damper to close in the event of power loss after holding it in an opened position for an extended period.

Naturally, versatility of use of a particular actuator requires it to be adaptable for use in association with a high temperature heating duct, a low temperature air conditioning duct, or in a relatively humid air return duct. Durability of an actuator is also important since it may be required to cycle the associated damper from closed to opened positions thousands of times, and must be sufficiently strong to withstand any shock loading attendant to automatic closure of the damper by its closing spring. Finally, in order to be sufficiently versatile to be cost effective in use, an actuator should be capable of operating dampers which have greatly differing input torque requirements, such as being capable of operating a damper requiring 12 inch-pounds of torque as well as a damper requiring 120 inch-pounds of torque.

Presently available fire damper actuators are of two general types. The first comprises a relatively low-torque electric motor which operates through a high reduction gear drive train. The low speed output of the drive train is directly coupled to the damper. This type of device functions to open the associated damper, with power to the electric motor then reduced so that the motor produces sufficient torque to hold the damper in its opened position against its closing spring. Not only must the gearing be configured so that the closing spring can close the damper and also turn the motor backwards, the unit must also withstand the relatively severe shock loading which occurs when the damper "slams" to its closed position under the action of its closing spring, thus quickly stopping the reverse spinning motor rotor.

This first type of actuator suffers from a number of distinct disadvantages. Typically, a relatively large number of gears are required in the gear reduction portion of the actuator, adding to its initial expense. Additionally, the motor of the actuator requires relatively large amounts of power to maintain the damper in its opened position, since relatively inefficient shaded pole alternating-current motors are typically employed. Because of the typically high gear reduction, a relatively small amount of drag on the rotor shaft of the motor can prevent the closing spring from properly closing the damper in the event of power failure. Since the motor is turned backwards at a fairly high speed during closing of the damper, relatively high shock loading occurs at the first-stage reduction gear teeth as the damper moves into its fully closed position as a result of the rotational inertia of the motor rotor. Damage to the gear teeth can result. Since this type of actuator typically employs an alternating current motor, a hum results from the continuous supply of power to the motor coil as it holds the damper open. This hum can be objectionably noisy.

Other disadvantages associated with this first type of actuator include the manner in which the damper is held in its open position. In some arrangements, the motor holds the damper open against a mechanical stop, but in such arrangements, the gear reduction drive train is subjected to more torque than necessary. In some arrangements, the torque output of the motor is balanced against the force of the damper closing spring, but this can result in the position of the damper changing, since the characteristics of the spring or the torque output of the motor may vary somewhat over time.

The second type of fire damper actuator which is presently available also comprises an electric motor which operates through a multi-stage gear reduction unit, but it also includes an electrically activated direct-current clutch which connects the actuator to the fire damper and its closing spring. This type of actuator further includes an electric brake. The brake operates on the rotor shaft of the motor and is normally engaged. This type of actuator operates to open the damper by supplying power to the electric clutch (which engages the clutch) and to the motor (which automatically disengages its brake). The motor then operates through the gear reduction unit to open the damper against the action of its closing spring. When the damper is fully opened, power to the motor is turned off, which reengages its brake, while power to the electric clutch is maintained. Thus, in essence, the clutch connects the damper to the now-braked motor rotor shaft (via the gear reduction unit) to maintain the damper in an opened position. In the event of power loss, the clutch disengages the damper and its closing spring from the actuator, permitting the damper to close.

This second style of actuator also suffers from a number of distinct disadvantages, principally relating to the required electric clutch. Not only is such a clutch relatively large in size, it must be configured to carry widely differing torques depending upon the torque requirements of the associated damper. Additionally, such an electric clutch is relatively expensive, and draws fairly substantial amounts of power when it is engaged and maintains the fire damper in an opened position against its closing spring.

In view of the distinct disadvantages associated with previously known fire damper actuator devices, it is desirable to provide an improved fire damper actuator which overcomes the disadvantages associated with previous designs. To this end, the fire damper actuator of the present invention has been particularly configured for economical manufacture, reliable and versatile use, low power consumption when operating to maintain an associated damper in an opened position, as well as low noise output when holding the damper open.

SUMMARY OF THE INVENTION

A fire damper actuator embodying the principles of the present invention is disclosed which has been configured for reliability, versatility, economical manufacture, and relatively low cost during use. The present actuator is adapted for use with a fire damper having one or more louvers which are movable between opened and closed positions. The damper is illustrated as including closing spring means associated with the louvers for urging the louvers to the closed position, but it will be understood that an actuator embodying the present invention may include the closing spring means. Notably, the present actuator is configured for operative connection directly to the associated damper without resort to an electric clutch or the like, and comprises a readily fabricated electric brake for maintaining the damper in an opened position against the action of the closing spring. Additionally, the present actuator includes a desirably straightforward one-way clutch mechanism which can function during spring-closing of the damper to temporarily disengage the motor of the actuator from its associated gear reduction means, thereby acting to prevent damage to the reduction gears from the rotational inertia of the rotor assembly of the actuator motor.

The present actuator includes an electric motor having a rotatable rotor shaft which may comprise a shaded pole alternating-current motor. The actuator further comprises multi-stage gear reduction means driven by the motor rotor shaft, with the reduction means in turn operatively connected with the louvers of the damper. By this construction, operation of the actuator motor acts in opposition to the damper closing spring to move the damper louvers from the closed position to the opened position.

The present actuator further includes an electric brake operatively connected with the rotor shaft of the motor. Actuation of the brake acts to brake rotation of the rotor shaft to maintain the damper louvers in the opened position in opposition to the closing spring when the electric motor is switched off. The electric brake is released when electrical current is not supplied thereto, whereby the damper closing spring moves the louvers from the opened position to the closed position. In distinction from previous actuators comprising an electric clutch, the present actuator is configured such that the closing spring for the damper acts during louver closing to drive the motor rotor shaft in a reverse direction opposite to the direction of rotation during opening of the louvers.

The present actuator is configured such that the rotor shaft of the motor rotates in a reverse direction during closing of the damper louvers by the closing spring. When the louvers slam shut, the still backwards spinning rotor must be prevented from damaging the now stationary gear train. To this end, the present actuator includes a one-way clutch mechanism which operatively connects the motor rotor shaft with a first-stage pinion of the gear reduction means, wherein the first-stage pinion is mounted on the rotor shaft. The one-way clutch mechanism acts to positively connect the rotor shaft in driving relation with the first-stage pinion of the reduction means when the actuator motor operates to open the damper louvers. The one-way clutch mechanism is further operable to permit disengagement of the first-stage pinion from driving relation with the rotor shaft when the closing spring for the damper moves the louvers into the closed position.

The one-way clutch mechanism comprises means mounting the first-stage pinion for sliding movement axially of the rotor shaft in opposition to a clutch spring mounted on the rotor shaft. The clutch mechanism further includes an engagement dog joined to the first-stage pinion. The engagement dog defines a driven surface engaged by a drive surface of the rotor shaft when the actuator motor drives the gear reduction means to open the damper louvers. The engagement dog further comprises a cam surface reactive with the drive surface of the rotor shaft for urging the first-stage pinion axially of the rotor shaft, in opposition to the clutch spring, out of driving relation with the rotor shaft when the damper closing spring has moved the louvers into the closed position and the rotational inertia of the rotor shaft exceeds a predetermined value. This predetermined value is selected so that the torque-carrying capacity of the reduction gearing is not exceeded, with the clutch thus "slipping" as may be required to prevent damage to the gear teeth from the rotational inertia of the reverse-spinning rotor shaft.

The electric brake of the present actuator has also been configured for economical manufacture, yet reliable and consistent operation. The brake comprises an axially fixed brake bracket mounted on the motor rotor shaft for rotation therewith, and a non-rotating brake stator mounted on the actuator motor, which includes a direct-current stator coil. The brake further comprises a ferrous brake plate mounted on the motor rotor shaft for freely sliding axial movement with respect thereto and with respect to the brake bracket mounted on the shaft. While the brake plate is freely slidable axially of the brake bracket, the brake plate is in engagement with the brake bracket so that the brake plate rotates together with the rotor shaft.

By this arrangement, actuation of the brake stator magnetically moves the brake plate axially of the rotor shaft into frictional braking engagement with the housing of the stator for braking rotation of the rotor shaft. The brake stator coil can desirably be configured for relatively low power consumption, thus permitting the present actuator to maintain the associated damper in its opened position for extended periods with minimal power usage. When the supply of power to the brake stator is discontinued, such as in the event of a power failure, the brake plate is released from braking engagement with the stator housing, and the rotor shaft is free to turn in reverse as the damper closing spring closes the damper. The brake preferably includes a brake release spring which urges the brake plate axially of the rotor shaft and out of engagement with the brake stator housing when the armature is deactivated, thus breaking any residual magnetism between the brake plate and the stator.

Numerous other features and advantages of the present invention will become readily apparent from the following detailed description, the accompanying drawings, and the appended claims.

BRIEF DESCRIPTION OF THE DRAWINGS

FIG. 1 is a diagramatic perspective view illustrating a fire damper, and a fire damper actuator embodying the principles of the present invention;

FIG. 2 is a relatively enlarged, partial perspective view further illustrating the fire damper and actuator shown in FIG. 1;

FIG. 3 is a side elevational view, partially in cross-section, illustrating the fire damper actuator of the present invention shown in FIG. 1;

FIG. 4 is a view, in partial cross-section, taken along line 4—4 of FIG. 3;

FIG. 5 is a cross-sectional view taken along line 5—5 of FIG. 4 illustrating an electric brake of the present actuator in a disengaged position;

FIG. 6 is a view similar to FIG. 5 illustrating the electric brake of the present actuator in an engaged position;

FIGS. 7–9 are relatively enlarged, elevational views illustrating a one-way clutch mechanism of the present actuator; and FIG. 10 is a cross-sectional view taken along line 10—10 of FIG. 8 further illustrating the one-way clutch mechanism of the present actuator.

DETAILED DESCRIPTION

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

Referring first to FIGS. 1 and 2, therein is illustrated a typical fire damper 10, with an associated fire damper actuator 12 embodying the principles of the present invention. As will be recognized by those familiar with the art, fire damper 10 typically includes a housing 14 for incorporation into the duct work of a ventilation system. The damper typically includes a plurality of mechanically interconnected louvers 16 which are mounted in housing 14 for movement together between opened and closed positions. In the opened position, free flow of air through the damper is permitted, while in the closed position of the louvers, flow through the damper is blocked.

With particular reference to FIG. 2, fire damper 10 typically includes a linkage 18 which operatively connects one of the interconnected louvers 16 with an associated operating shaft 20. In order to continuously urge louvers 16 from their opened position to their closed position, fire damper 10 can include a closing spring 22, which in the typical arrangement illustrated comprises a torsion coil spring 22 mounted on operating shaft 20. Thus, closing spring 22 operates through shaft 20 and linkage 18 to urge louvers 16 into their closed position. In order to move the louvers 16 from their closed position to their opened position in opposition to spring 22, the actuator 12 of the present invention includes an output shaft 20' operatively connected to the operating shaft 20 by a suitable coupling at 21. For some applications, it can be desirable to incorporate the damper closing spring into the actuator itself. To this end, the actuator 12 can include a suitable closing spring 22' operatively connected to an extension of output shaft 20' as illustrated in phantom line in FIG. 3.

The configuration of actuator 12 will now be described in detail. Referring particularly to FIGS. 3–6, actuator 12 includes an electric motor 24 which may preferably comprise a relatively inexpensive shaded pole alternating-current motor. This type of motor typically includes a frame, generally designated 26, with the frame carrying a stacked lamination of ferrous metal stator plates 28. The motor further typically includes a stator coil or armature 30 for generating the magnetic field of the motor stator. Motor 24 further includes a rotatable rotor shaft 32 having a rotor assembly 34 (FIGS. 5 and 6) mounted thereon.

Actuator 12 further includes a gear reduction unit 36 which is preferably joined to electric motor 24 so that actuator 12 is of a unitary and integrated configuration. The gear reduction unit includes a reduction housing 36 which encloses a multi-stage gear ratio reducing drive train. Thus, gear reduction unit 36 is preferably configured to effect multiple gear ratio reduction (and thus torque-multiplication) of the rotation of motor rotor shaft 32 operatively connected to the gear reduction unit.

In a present embodiment, a three-stage gear reduction has proven to be a desirable compromise between the torque input requirements of the reduction unit and the number of gear ratio reductions effected. Thus, the reduction unit includes a first-stage pinion 40 mounted on rotor shaft 32, and a first-stage gear 42 meshed with pinion 40. Gear 42 is in turn joined to a second-stage pinion 44 which meshes with a second-stage gear 46. Gear 46 is mounted for rotation together with a third-stage pinion 48 which drives a third-stage gear 50 operatively connected with output shaft 20' of the actuator 12. Because a three-stage gear ratio reduction is preferably effected, as opposed to a five-stage reduction employed in previous damper actuator devices, the present actuator desirably avoids jamming or the like during damper closing, which might otherwise occur attendant to excessive friction on the motor rotor shaft (from dirt or debris) if a relatively high gear reduction were effected.

As will be appreciated, operation of motor 24 results in rotor shaft 32 driving operating shaft 20 via the gear reduction unit 36, with the motor 24 thus acting to open the louvers 16 of the damper 10 in opposition to closing spring 22. Conversely, louvers 16 are moved from their opened position to their closed position by closing spring 22, with the closing spring acting through the gear reduction unit to rotate rotor shaft 32 in a reverse direction during closing of damper 10. As will be recognized, this arrangement is distinct from previous fire damper actuators comprising an electric clutch which disengages the actuator reducing gears and motor from the louvers and the closing spring during damper closing.

During closing, the force of closing spring 22 acting through gear reduction unit 36 can rotate rotor shaft 32 and its rotor assembly 34 at relatively high speed. However, as soon as the louvers of the damper move into their fully closed position, the gears within reduction unit 36 stop rotating. Because of the rotational inertia of the reverse-spinning rotor shaft 32, undesirably high stresses can be created on the gear teeth of the reduction unit, particularly at the first-stage reduction pinion 40 and gear 42. Accordingly, the present actuator is preferably provided with a one-way clutch mechanism which operatively connects the rotor shaft 32 with the first-stage pinion 40.

The one-way clutch mechanism is best illustrated in FIGS. 7–10, which show a portion of rotor shaft 32 and first-stage pinion 40 mounted thereon. As will be appreciated, the clutch mechanism is desirably straightforward in configuration for economy and reliability, and functions to permit continued reverse rotation of rotor shaft 32 (due to its rotational inertia) after the louvers of the damper have been fully closed. The clutch mechanism first comprises means for mounting first-stage pinion 40 for sliding movement axially of rotor shaft 32, with the pinion 40 being slidably mounted on a reduced shaft portion 52 to this end. Sliding axial movement of the pinion 40 toward the end of the rotor shaft is in opposition to a clutch spring 54, illustrated as comprising a compression coil spring mounted in captive relation on reduced shaft portion 52.

The one-way clutch mechanism further includes a tab-like engagement dog 56 joined to first-stage pinion 40, and preferably formed integrally therewith. Engagement dog 56 defines a flat driven surface 58 (FIG. 10) arranged parallel and in spaced relation to the rotational axis of rotor shaft 32. The engagement dog 56 further defines a cam surface 60 which is perpendicular to driven surface 58, and which extends at an angle, such as 45 degrees, with respect to the axis of shaft 32.

Driven surface 58 coacts and cooperates with a flat drive surface 62 defined by rotor shaft 32 for coupling the rotor shaft and the pinion 40 in driving relation. Spring 54 normally urges pinion 42 to the position shown in FIGS. 7 and 8, with the engagement of surfaces 62 and 58 coupling the shaft 32 and pinion 40 in driving relation. In this relative position of the pinion 40 and the shaft 42, the shaft is arranged to drive the pinion for opening of damper 10, and hold the damper open by virtue of the electric brake of the actuator (as will be further described) acting on the rotor shaft.

During closing of the damper by closing spring 22, spring 54 maintains pinion 40 and shaft 32 in driving relation, with closing spring 22 thus acting through the gear reduction unit to rotate rotor shaft 32 in the reverse direction. When the louvers of the damper have moved to their fully closed position, the gears of the reduction unit, including pinion 40, stop rotating. At this moment, the rotational inertia of rotor shaft 32 and its rotor assembly is relatively high. As a consequence, rotor shaft 32 exerts a torque on the clutch mechanism which results in a force component which urges pinion 40 axially of rotor shaft 32 against spring 54. Drive surface 62 of the rotor shaft acts against cam surface 60 of engagement dog 56 to urge pinion 40 axially in this manner without damage to the various engagement surfaces. If the axial force component is sufficient to overcome the force of spring 54, pinion 40 is moved axially until surface 62 of the rotor shaft is disengaged from dog 56 (see FIG. 9). Shaft 32 continues to rotate until surface 62 is realigned with surface 58 of dog 56, whereupon pinion 40 is urged back to its original position by spring 54. If the rotor shaft is still exerting sufficient torque on the clutch mechanism, the sequence will repeat.

Thus, the shaft 32 continues to rotate as long as its rotational inertia exceeds a predetermined value corresponding to the torque-carrying capacity of the one-way clutch mechanism, and the rotor shaft 32 may continue to rotate in its reverse direction (ordinarily for 10 or 20 revolutions) even though the associated damper has fully closed. As illustrated in FIG. 3, first-stage pinion 40 is arranged with respect to first-stage gear 42 such that pinion 40 and gear 42 remain in mesh as the pinion shifts axially of rotor shaft 32. Thus, the clutch mechanism permits limited "slippage" of the rotor shaft with respect to the first-stage pinion 40 after the louvers of damper 10 have moved into their fully closed position.

As noted above, the present actuator 12 includes an electric brake which is operatively connected with rotor shaft 32 for braking the rotor shaft against rotation, thus holding louvers 16 in their opened position against the action of closing spring 22. Notably, the illustrated embodiment of this brake arrangement has been particularly configured for both economy of manufacture and reliable operation, and notably, overcomes disadvantages associated with previous electric brake constructions.

The electric brake of the present arrangement is generally designated 66, and comprises a direct-current brake stator coil 68 mounted within a non-rotating ferrous metal brake stator housing 70 mounted on actuator motor 24. Stator housing 70 substantially surrounds the toroid-shaped stator coil on three sides, with the housing being open at its outer axial end. The stator housing 70 acts as a non-rotating, friction-generating component of the electric brake.

The brake 66 further includes a preferably generally U-shaped brake bracket 72 mounted on rotor shaft 32 for rotation therewith. To this end, the brake bracket 72 can be configured to define a D-shaped cutout which receives a portion of rotor shaft 32 having a machined flat 74 (see FIG. 4). A suitable clip 76 affixed to shaft 32 holds the brake bracket 72 in position thereon.

The electric brake further includes a generally disk-shaped ferrous brake plate 78 mounted on rotor shaft 32 generally between brake bracket 72 and stator housing 70. Notably, brake plate 78 is mounted on rotor shaft 32 for freely sliding axial movement with respect to the rotor shaft and with respect to brake bracket 72. While brake plate 78 is movable axially of brake bracket 72, the brake plate is in engagement with the brake bracket for rotation therewith. To this end, the brake plate defines a pair of openings 80 through which the "arms" of the brake bracket 72 respectively extend. Brake plate 78 functions as the rotatable friction-generating component of brake 66, and functions in the nature of an armature for cooperation with the brake stator.

With particular reference to FIGS. 5 and 6, the brake 66 preferably includes a bushing 82 mounted for axial movement on rotor shaft 32, with the bushing 82 being biased to the position shown in FIG. 5 by an associated spring washer 84. The edge of bushing 82 thus protrudes from the friction surface of stator housing 70.

FIG. 5 illustrates brake 66 in its deactivated or de-energized state, such as during opening or closing rotation of rotor shaft 32. In this condition of the brake, brake plate 78 is freely slidable axially of the rotor shaft, and is spaced from the non-rotating stator housing 70. Rotor shaft 32 is thus freely rotatable without any braking of its rotation.

Upon actuation of brake stator coil 68 for braking rotation of rotor shaft 32 to maintain damper 10 open, the stator coil 68 cooperates with its housing 70 to create a magnetic field which draws brake plate 78 axially into frictional braking engagement with stator housing 70. The brake plate 78 first slides freely along rotor shaft 32, and then engages the bushing 82, thereby acting in opposition to spring 84 as the brake plate engages housing 70. The brake is now engaged, with continued energization of stator coil 68 holding the rotor shaft 32 against rotation.

In the event of power loss, brake stator 68 is de-energized, and the magnetic attraction holding brake plate 78 in braking engagement with housing 70 is released. In the event that any residual magnetism continues to draw the brake plate 78 to the housing 70, the spring 84 acts through bushing 82 to disengage the brake plate from housing 70. Disengagement of the brake plate 78 from housing 70 permits rotor shaft 32 to rotate freely, thus permitting the closing spring 22 for damper 10 to move louvers 16 from the opened to the closed position.

It should be noted that by employing a direct-current stator coil in the present construction, no "hum" is generated whereby the present actuator is desirably quiet. Additionally, the operative connection of the brake 66 to rotor shaft 32 arranges the brake to act through gear reduction unit 36 when the brake acts in opposition to damper closing spring 22; the brake can thereby be sized for minimal power consumption, with power consumption being much less than that of a comparably-sized damper actuator employing an electric clutch provided at the output of the actuator's reducing gears.

As will be appreciated, electric braking arrangements other than the illustrated brake 66 can be incorporated in a fire damper actuator embodying the principles disclosed herein. However, the illustrated brake 66 offers a number of distinct advantages over other types of electric brake arrangements. For example, one currently available electric brake comprises a non-rotating brake stator and housing which effects braking by attraction of a rotating brake disk mounted on a motor rotor shaft by a leaf spring. In such a construction, axial movement of the brake disk is always in opposition to the leaf spring. This leaf spring must be sufficiently strong to overcome any residual magnetism between the brake disk and the stator housing, but since the stator must act in opposition to the spring, the "air gap" between the stator housing and the brake disk must be very carefully maintained; the magnetic attraction exerted by the stator housing on the brake disk drops off rapidly with an increase in the air gap. Invariably, the initial air gap varies from one motor to the next due to assembly variations, and the air gap can vary on any given motor due to rotor shaft end play. These aspects of the construction can undesirably complicate configuring the brake for reliable and consistent operation.

In contrast, the electric brake 66 which is illustrated is configured to permit freely sliding axial movement of the brake plate 78 during its initial movement toward stator housing 70, and thus the existence of a relatively large air gap or an air gap which may vary from one motor to the next, poses no problem. The construction desirably automatically compensates for any end play in the rotor shaft, and precise setting of the air gap during assembly is obviated. The force of the spring 84 which disengages the brake plate 78 and the stator housing 70 when the stator is deactivated is independent of the position of the plate on the rotor shaft, and is thus more predictable. In previous arrangements, the leaf spring-loaded brake disk has typically been adjustably mounted on a rotor shaft for "presetting" of the air gap; the versatility of the present construction obviates the need for such presetting, and permits the use of a more reliable and less expensive "flat and D-slot" interconnection between bracket 78 and shaft 32, as illustrated.

From the foregoing description of the present fire damper actuator 12, the manner in which it operates and cooperates with the associated damper will be readily appreciated. During opening movement of louvers 16, motor 24 is operated such that rotation of rotor shaft 32 operates through the multi-stage gear reduction unit 36 to turn operating shaft 20 in opposition to closing spring 22. When louvers 16 have reached their fully opened position, suitable switching means preferably discontinues operation of electric motor 24, reducing power consumption. The switching means also energizes brake 66 by actuation of brake stator coil 68. Actuation of brake stator 68 moves brake plate 78 axially of rotor shaft 32 into frictional braking engagement with stator housing 70, thus maintaining louvers 16 in their fully opened position.

In the event of power loss, brake stator coil 68 is deactivated, thus permitting brake plate 78 to disengage stator housing 70, permitting rotor shaft 32 to turn freely. Closing spring 22 operates to move louvers 16 to their fully closed position, with the closing spring 22 acting through gear reduction unit 36 to rotate rotor shaft 32 in reverse. After louvers 16 have fully closed, the gears of reduction unit 36 stop rotating, with the rotational inertia of the rotor shaft 32 and its rotor assembly dissipated by the one-way clutch mechanism which operatively connects the rotor shaft with the first-stage pinion 40.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. It is, of course, intended to cover by the appended claims all such modifications as fall within the scope of the claims.

What is claimed is:

1. An actuator for a fire damper having louver means movable between opened and closed positions, and associated closing spring means for urging said louver means to said closed position, said actuator comprising:

electric motor means having a rotatable rotor shaft;

gear reduction means operatively connected with said louver means, said gear reduction means being driven by said rotor shaft whereby said motor means acts in opposition to said closing spring means to move said louver means from said closed position to said opened position; and electric brake means operatively connected with said rotor shaft, whereby actuation of said brake means after said electric motor means has been switched off brakes rotation of said rotor shaft to maintain said louver means in said opened position, said brake means being released when electric current is not applied thereto, whereby said closing spring means moves said louver means from said opened position to said closed position, said closing spring means acting during closing of said louver means to drive said rotor shaft of the switched-off motor means in a reverse direction opposite the direction of rotation during opening of said louver means.

2. A fire damper actuator in accordance with claim 1, wherein said gear reduction means comprises multi-stage gear reduction means.

3. A fire damper actuator in accordance with claim 1, including one-way clutch means operatively connecting said rotor shaft with said gear reduction means, said clutch means positively connecting said rotor shaft in driving relation with said reduction means when said electric motor means operates to open said louver means, said clutch means being operable to permit disengagement of said reduction means from driving relation with said rotor shaft when said closing spring means moves said louver means into said closed position.

4. A fire damper actuator in accordance with claim 1, wherein said brake means comprises non-rotating electrical stator means mounted on said motor means, brake bracket means mounted on said rotor shaft for rotation therewith, and brake plate means mounted on said rotor shaft for freely sliding movement axially of said rotor shaft and said brake bracket means, said brake plate means being in engagement with said brake bracket means for rotation with said rotor shaft, whereby actuation of said stator means moves said brake plate means axially of said rotor shaft and into braking engagement with said stator means for braking rotation of said rotor shaft.

5. A fire damper actuator in accordance with claim 4, wherein said brake means further includes brake release spring means for urging said brake plate means axially of said rotor shaft and out of engagement with said stator means when said stator means is deactivated.

6. A fire damper actuator in accordance with claim 3, wherein said gear reduction means comprises a first-stage pinion mounted on said rotor shaft, said one-way clutch means comprising means mounting said first-stage pinion for sliding movement axially of said rotor shaft in opposition to clutch spring means, said clutch means further comprising engagement dog means joined to said first-stage pinion, said dog means defining a driven surface engaged by a drive surface of said rotor shaft when said motor means drives said gear reduction means to open said louver means, said engagement dog means further comprising a cam surface reactive with said drive surface of said rotor shaft for urging said pinion axially of said rotor shaft in opposition to said clutch spring means and out of driving relation with said rotor shaft when said closing spring means has moved said louver means to said closed position and the rotational inertia of said rotor shaft exceeds a predetermined value.

7. A fire damper actuator in accordance with claim 1, wherein said gear reduction means includes an output shaft operatively connected with said louver means, said actuator including said closing spring means operatively connected to said output shaft.

8. An actuator for a fire damper having louver means movable between opened and closed positions, and associated closing spring means for urging said louver means to said closed position, said actuator comprising:

electric motor means having a rotatable rotor shaft;

multi-stage gear reduction means operatively connected with said louver means and configured for effecting multiple gear ratio reduction, said gear reduction means being driven by said rotor shaft whereby said motor means acts in opposition to said closing spring means to move said louver means from said closed position to said opened position;

one-way clutch means operatively connecting said rotor shaft with said gear reduction means, said clutch means positively connecting said rotor shaft in driving relation with said reduction means when said electric motor means operates to open said louver means, said clutch means being operable to permit disengagement of said reduction means from driving relation with said rotor shaft when said closing spring means moves said louver means into said closed position; and electric brake means operatively connected with said rotor shaft, whereby actuation of said brake means after said electric motor means has been switched off brakes rotation of said rotor shaft to maintain said louver means in said opened position, said brake means being released when electrical current is not supplied thereo, whereby said closing spring means moves said louver means from said opened position to said closed position, said closing spring means acting during closing of said louver means to drive said rotor shaft of the switched-off motor means in a reverse direction opposite the direction of rotation during opening of said louver means.

9. A fire damper actuator in accordance with claim 8, wherein said electric brake means comprises non-rotating electrical brake stator means mounted on said motor means, brake bracket means mounted on said rotor shaft for rotation therewith, and brake plate means mounted on said rotor shaft for freely sliding movement axially of said rotor shaft and said brake bracket means, said brake plate means being in engagement with said brake bracket means for rotation with said rotor shaft, whereby actuation of said stator means moves said brake plate means axially of said rotor shaft and said brake bracket means into braking engagement with said stator means for braking rotation of said rotor shaft.

10. A fire damper actuator in accordance with claim 9, wherein said electric brake means further comprises brake release spring means for urging said brake plate means axially of said rotor shaft and out of engagement with said electrical stator means when said stator means is deactivated.

11. A fire damper actuator in accordance with claim 8, wherein said multi-stage gear reduction means comprises a first-stage pinion mounted on said rotor shaft, said one-way clutch means comprising means mounting said first-stage pinion for sliding movement axially of said rotor shaft in opposition to clutch spring means;

said clutch means further comprising engagement dog means joined to said first-stage pinion, said dog means defining a driven surface engaged by a drive surface of said rotor shaft when said motor means drives said gear reduction means to open said louver means, said engagement dog means further comprising a cam surface reactive with said drive surface of said rotor shaft for urging said first-stage pinion axially of said rotor shaft in opposition to said clutch spring means and out of driving relation with said rotor shaft when said closing spring means has moved said louver means to said closed position and the rotational inertia of said rotor shaft exceeds a predetermined value.

12. A fire damper actuator in accordance with claim 8, wherein said gear reduction means includes an output shaft operatively connected with said louver means, said actuator including said closing spring means operatively connected to said output shaft.

* * * * *

UNITED STATES PATENT AND TRADEMARK OFFICE

CERTIFICATE OF CORRECTION

PATENT NO. : 4,581,987

DATED : April 15, 1986

INVENTOR(S) : Dennis J. Ulicny

It is certified that error appears in the above-identified patent and that said Letters Patent is hereby corrected as shown below:

Title page:

In the Abstract, line 18, after the word "mechanism", insert the phrase --which operatively connects the motor rotor shaft--.

Signed and Sealed this

*Fifteenth* Day of *July 1986*

[SEAL]

*Attest:*

*Attesting Officer*

DONALD J. QUIGG

*Commissioner of Patents and Trademarks*